US011684134B2

(12) United States Patent
Zheng et al.

(10) Patent No.: US 11,684,134 B2
(45) Date of Patent: Jun. 27, 2023

(54) PACKAGING AND APPLICATOR DEVICE FOR EYELINER

(71) Applicant: APR Beauty Group Inc., Toronto (CA)

(72) Inventors: Min-Yan Zheng, Toronto (CA); Feng-Ying Fu, Markham (CA)

(73) Assignee: APR Beauty Group, Inc., Toronto (CA)

( * ) Notice: Subject to any disclaimer, the term of this patent is extended or adjusted under 35 U.S.C. 154(b) by 303 days.

(21) Appl. No.: 17/138,431

(22) Filed: Dec. 30, 2020

(65) Prior Publication Data

US 2022/0202163 A1 Jun. 30, 2022

(51) Int. Cl.

| | |
|---|---|
| ***A45D 34/04*** | (2006.01) |
| ***A45D 40/20*** | (2006.01) |
| ***A45D 40/26*** | (2006.01) |

(52) U.S. Cl.

CPC .... *A45D 34/042* (2013.01); *A45D 2200/1009* (2013.01); *A45D 2200/1072* (2013.01)

(58) Field of Classification Search

CPC .... A45D 34/04; A45D 34/042; A45D 34/045; A45D 34/046; A45D 2200/1009; A45D 2200/1063; A45D 2200/1072; A45D 40/20; A45D 40/24; A45D 40/261; A45D 40/262; A45D 40/28; A26B 2200/1053

See application file for complete search history.

(56) References Cited

U.S. PATENT DOCUMENTS

| | | | | |
|---|---|---|---|---|
| 4,792,252 | A * | 12/1988 | Kremer | B43K 5/1845 401/206 |
| 6,302,607 | B1 * | 10/2001 | Burrowes | A45D 34/04 401/23 |
| 9,877,565 | B2 * | 1/2018 | Sasaki | A45D 34/042 |
| 10,506,864 | B2 * | 12/2019 | Sasaki | A45D 40/205 |
| 2007/0140773 | A1 * | 6/2007 | Gueret | A45D 34/045 401/129 |
| 2016/0128445 | A1 * | 5/2016 | Lim | A45D 34/042 132/317 |
| 2016/0213124 | A1 * | 7/2016 | Tanaka | A45D 34/041 |
| 2016/0374454 | A1 * | 12/2016 | Liu | A45D 34/042 401/198 |

(Continued)

OTHER PUBLICATIONS

Insider Beauty, Erasable Eyeliner: Liquid Linerand Makeup Eraser in One Liner, Youtube (https://www.youtube.com/watch?v=aCfpSOStWVQ) (Oct. 24, 2017) (Year: 2017).*

*Primary Examiner* — Jacqueline T Johanas
*Assistant Examiner* — Zachary Alexander Kim

(57) ABSTRACT

A packaging and applicator device comprising a container containing a liquid composition for application, an applicator capable of being fastened removably on the container, and a corrector mounted at one end of the applicator. The applicator includes a rod, an applicator endpiece at a distal end of the rod, and a handle member connected to a proximal end of the rod. The applicator endpiece is made of a felt tip that can be impregnated with the composition contained in the container, and wherein the applicator endpiece is used for applying eyeliner. The packaging and applicator device further includes a filter adjacent to the applicator endpiece to supply the liquid composition to the applicator endpiece during application.

18 Claims, 6 Drawing Sheets

(56) References Cited

U.S. PATENT DOCUMENTS

| | | | | |
|---|---|---|---|---|
| 2017/0006998 | A1* | 1/2017 | Liu | B43K 8/06 |
| 2017/0156474 | A1* | 6/2017 | Djarar Fischer | A45D 40/30 |
| 2018/0000225 | A1* | 1/2018 | Liu | A45D 34/042 |
| 2019/0166979 | A1* | 6/2019 | Hale | A45D 44/00 |
| 2019/0298032 | A1* | 10/2019 | Mahmood | A45D 34/042 |

* cited by examiner

SECTION A-A

PACKAGING AND APPLICATOR DEVICE FOR EYELINER

BACKGROUND

Field of the Invention

The present disclosure relates to packaging and applicator devices for eyeliner.

Description of the Related Art

Eyeliner applicators are known that include a stem provided at one end with an applicator endpiece constituted by a tip that is tapering, e.g., of generally conical shape.

U.S. Pat. No. 7,077,592 describes an applicator enabling a line to be drawn with greater or smaller width by means of the presence of two tips. Nevertheless, it is quite difficult to draw a broad line or a narrow line since the tips tend to splay apart from each other under the effect of the pressure exerted against the skin.

Patent application FR 2 890 296 describes another applicator for applying an eyeliner, in which the application endpiece is formed by a flocked endpiece, a felt tip, or a bundle of bristles.

U.S. Pat. No. 4,974,980 describes an eyeliner applicator having a tip that forms a cylindrical body of revolution.

There exists a need to benefit from a packaging and applicator device for a cosmetic composition, in particular an eyeliner that is simple to fabricate and to use. Further, there is needed a packaging and applicator device that enables an applicator thereof to carry sufficient amount of product for a single application without requiring re-dips.

Also, there is a need for a packaging and applicator device that includes a corrector along with the eyeliner applicator in the single package that enables a user to rectify mistakes during application.

SUMMARY

Accordingly, there is provided a packaging and applicator device comprising a container containing a liquid composition for application, an applicator, particularly an eyeliner applicator, capable of being fastened removably on the container, and a corrector mounted at one end of the applicator. The applicator includes a rod, an applicator endpiece of elongate shape at a distal end of the rod, and a handle member connected to a proximal end of the rod. The handle member also serves as a closure cap for closing the container in a leak tight manner when not in use.

According to an aspect of the present disclosure, the applicator endpiece is made of a felt tip that can be impregnated with the composition contained in the container. Felt tip applicator allows for precision application, and to easily create bold or thin lines. The applicator endpiece comprises a body having a proximal portion, a middle portion and a distal portion. The proximal portion and the middle portion of the applicator endpiece are received in a cavity at a distal portion in the rod and held therein.

According to an aspect of the present disclosure, the middle portion of the applicator endpiece is circularly cylindrical whereas the proximal portion and the distal portion are conical or frustoconical in shape. In alternate embodiments, the applicator end piece may be of any other shape.

According to another aspect of the present disclosure, the rod is a hollow body comprising a cavity. The cavity of the rod is configured to receive the applicator endpiece such that a portion of the applicator end piece projects out from a distal opening of the cavity; and wherein the cavity also houses a filter adjacent to the applicator endpiece that stores and supplies a surplus amount of liquid composition to the applicator endpiece during application.

According to yet another aspect of the present disclosure, the cavity of the rod reduces in cross sectional dimension towards the distal portion of the rod. Thus, the cavity of the rod has at least two different diameters, wherein the diameter of the cavity being smallest at the distal portion of the rod. This reduced dimension portion of the cavity is shaped and sized corresponding to an outer diameter of the applicator endpiece such that the middle portion of the applicator endpiece is fittingly received therein. Further, the rod houses the filter in the cavity of the rod in a portion adjacent to the reduced dimension portion of the cavity and a proximal portion of the applicator endpiece is inserted in the filter. The filter is made of an absorbing material that is configured to absorb the liquid composition by the capillary phenomenon through the applicator endpiece from the container when the applicator is dipped in the container, and thus the filter acts as a reservoir to store the liquid composition. During application the filter continuously and smoothly supplies the liquid composition stored therein to the applicator endpiece in a constant amount for a single application. Thus, the filter is configured to hold more composition in the applicator in a single dip as compared to conventional eyeliner packages. In other embodiments, the filter may also be a pre-filled filter.

According to yet another aspect of the present disclosure, the container comprises a body which may be of arbitrary shape, and which is provided with a threaded neck having a wiper member mounted therein.

According to yet another aspect of the present disclosure, the applicator endpiece extends along a longitudinal axis, which axis may be rectilinear and may for example coincide with a longitudinal axis of the device.

According to yet another aspect of the present disclosure, a plug is provided which is adapted to be received within the cavity of the rod from an open proximal end of the rod. The plug comprising a first cylindrical shaft and a second cylindrical portion comprising an annular shoulder. The annular shoulder of the plug is sized for supporting engagement with an annular shoulder of the rod. The first cylindrical shaft of the plug extends longitudinally inside the cavity of the rod and sealingly locks with an internal surface of the rod. Further, a distal end of the plug rests on a top surface of the filter. The plug, thus prevents possibility of escape of fluid or of the filter from the cavity of the rod.

According to yet another aspect of the present disclosure, the corrector is arranged on a proximal end portion of the handle member of the device. The corrector is capable of correcting or erasing portions of a line drawn incorrectly during application using said applicator endpiece. The corrector includes a first correcting member and a second correcting member. According to an embodiment, the first correcting member is made of silicon material and the second correcting member is made of sponge. In other embodiments, the first correcting member may be made up of other polymeric material like polyethylene, thermoplastic elastomers, rubber and the like. In still other embodiments, the second correcting member may be made up of other materials having absorbing properties for e.g., foam, cotton, modal, micro-modal, Tencel®, and other viscose-based fibers, silica gel and the like.

According to yet another aspect of the present disclosure, the first correcting member comprises a body having a central bore, and wherein the first correcting member elongates along the central longitudinal axis of the device. The first correcting member is configured to be snapped on a proximal end portion of the handle member, and wherein the first correcting member comprises at least one snapping groove on its inner surface for receiving at least one snapping projection present at a proximal end portion of the handle member. The proximal end portion of the handle member is shaped in a conical form that can be received snappingly within the central bore of the first correcting member.

According to yet another aspect of the present disclosure, the body of the first correcting member comprises at least one sidewall and a top face. The top face of the first correcting member includes a substantially flat surface portion and a concavely inclined opening of the central bore that extends down from the flat surface portion. Furthermore, the substantially flat surface portion projects outwardly from the at least one sidewall of the body of the first correcting member. The substantially flat surface portion tapers as it extends outwardly from the sidewall and forms a narrow tip away from the sidewall of the first correcting member. During application, the substantially flat surface portion of the first correcting member provides a tapering edge or a narrow tip that can be used to aid in creating sharp edged lines. Further, the tapering edge or the narrow tip can be used to define edges of the thick lines drawn by the user.

Further, the second correcting member is accommodated in the central bore of the first correcting member such that at least a portion of an upper surface of the second correcting member projects from the concavely inclined opening of the central bore. The upper surface of the second correcting member forms a convex application surface at a distal end surface of the corrector. More particularly, the second correcting member is placed between the first correcting member and the proximal end portion of the handle member before snapping the proximal end portion of the handle member into the central bore of the first correcting member, so that when the handle member and the first correcting member are snapped a side wall of the second correcting member is sandwiched between the first correcting member and the proximal end portion of the handle member.

During application, the second correcting member helps in correcting or erasing the mistakes or bleeding marks. More particularly, the convex upper surface of the second correcting member helps in correcting or erasing the mistakes or bleeding marks.

Furthermore, the handle member comprises a neck portion below the conical proximal end portion of the handle member. A corrector cap is provided for placement onto the neck portion of the handle member for protecting the corrector from dust and contamination during non-use. The neck portion comprises a retention bead on its outer surface for snap-fit engagement with a groove formed on an inner surface of the side wall of the corrector cap. In alternate embodiments, any other coupling means known in the art may be employed for coupling the corrector cap on to the neck portion of the handle member.

Various shape modifications may be made to the applicator end piece without going beyond the ambit of the present invention.

The handle member may present a shape that may or may not be a body of revolution, in particular it may have a flat sidewall shape. The handle member may have a varying cross-sectional profile, for e.g., the handle member has a triangular cross-sectional profile towards a proximal portion thereof and a circular cross-sectional profile towards the distal portion thereof. Further, the corrector cap also has a triangular profile that matches with the triangular profile of the proximal portion of the handle member on which it is mounted. In other embodiments, the handle member and the corrector cap may present a shape that may be a body of revolution.

The container may be made in various ways, and for example it may be made other than by injection blow molding, for example it may comprise two parts that are assembled together.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
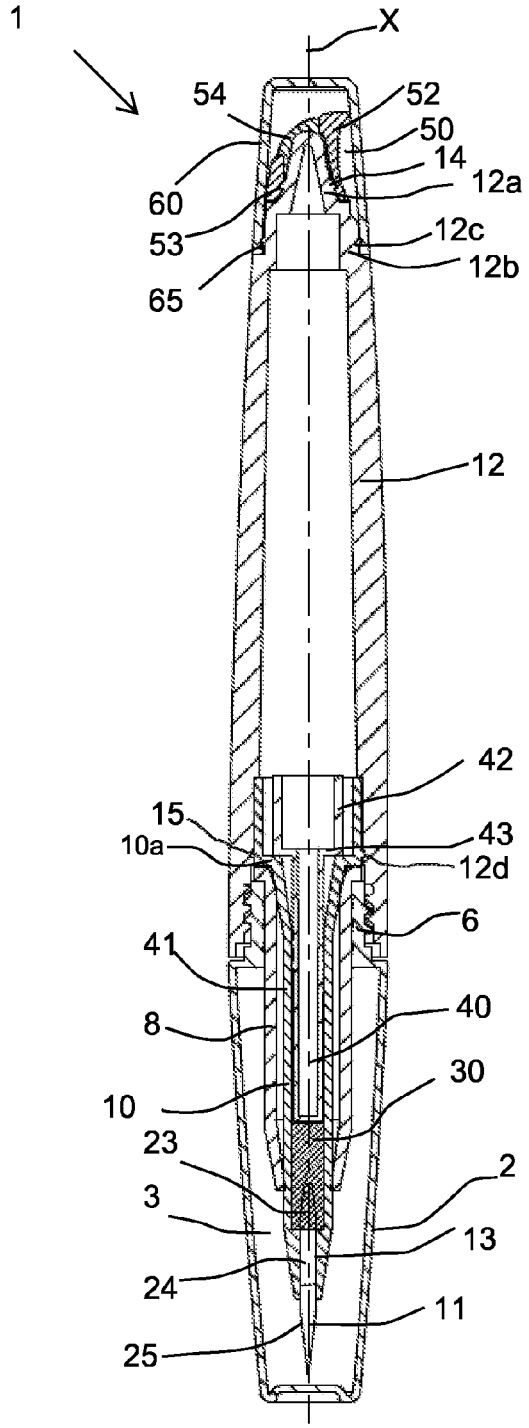
FIG. 1 is a longitudinal section view of a packaging and applicator device made in accordance with the present disclosure.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

The packaging and applicator device 1 shown in FIG. 1 comprises a container 2 containing a liquid composition (not shown) for application, an eyeliner in the example under consideration, and an applicator 3 capable of being fastened removably on the container 2.

The container 2 comprises a body which may be of arbitrary shape, and is provided in the example shown with a threaded neck 6 having a wiper member 8 mounted therein.

The applicator 3 includes a rod 10 carrying an applicator endpiece 11 of elongate shape at a distal end thereof and along a longitudinal axis X, which axis may be rectilinear and may for example coincide with a longitudinal axis of the device, as shown.

The rod 10 is connected at its proximal end to a handle member 12 which also serves as a closure cap for closing the container 2 in a leak tight manner when not in use. More particularly, a protrusion 15 on an outer surface of a proximal portion of the rod 10 engages with a corresponding groove 12*d* on an inner surface of a distal portion of the handle member 12.

Figure 12:
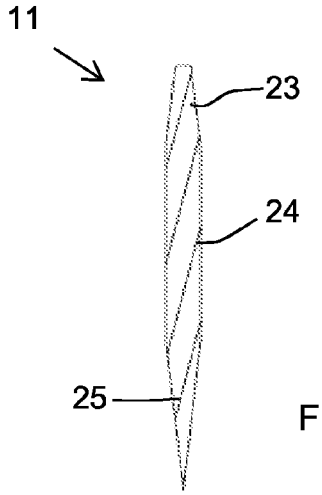
FIG. 12 is a cross sectional view of an applicator endpiece of the packaging and applicator device of FIG. 1.

According to an aspect of the present disclosure, the applicator endpiece 11 is made of a felt tip that can be impregnated with the composition contained in the container. The felt tip applicator endpiece 11 allows for precision application, and to easily create bold or thin lines. As shown in FIG. 12 in detail, the applicator endpiece 11 comprises a body having a proximal portion 23, a middle portion 24 and a distal portion 25. Referring to FIG. 1, the proximal portion 23 and the middle portion 24 of the applicator endpiece 11 are received in a cavity 13 at a distal portion in the rod 10 and held therein, while the distal portion 25 of the applicator endpiece 11 projects out from the rod 10 from a distal opening of the cavity 13.

According to an aspect of the present disclosure, the middle portion 24 of the applicator endpiece 11 is circularly cylindrical whereas the proximal portion 23 and the distal portion 25 are conical or frustoconical in shape, as shown in FIG. 12. In alternate embodiments, the applicator endpiece 11 may have any other shape.

Figure 11:
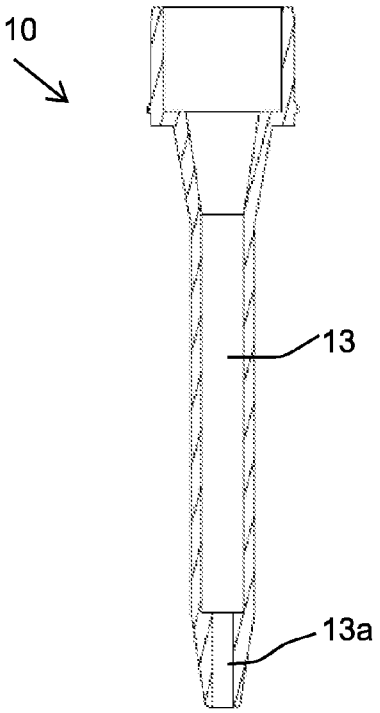
FIG. 11 is cross sectional view of a rod of the packaging and applicator device of FIG. 1.

As shown in FIGS. 1 and 11, the rod 10 is hollow body and comprises a cavity 13 that reduces in cross sectional dimension towards the distal portion of the rod 10. The cavity 13 thus has at least two different diameters, wherein the diameter of the cavity 13 being smallest at the distal portion of the rod 10. This reduced dimension portion 13*a* of the cavity 13 is shaped and sized corresponding to an outer diameter of the middle portion 24 of the applicator endpiece 11 for fittingly receiving the applicator endpiece 11 therein. Further, as shown in FIG. 1, the rod 10 houses a filter 30 in a portion of the cavity 13 of the rod 10 adjacent to the reduced dimension portion 13*a* of the cavity 13 and a proximal portion 23 of the applicator endpiece 11 is inserted in the filter 30. The filter 30 is made of an absorbent material that is configured to absorb the liquid composition by the capillary phenomenon through the applicator endpiece 11 from the container 2 when the applicator 3 is dipped in the container 2, and thus the filter 30 acts as a reservoir to store the liquid composition. During application the filter 30 continuously and smoothly supplies the liquid composition stored therein to the applicator endpiece 11 in a constant amount. Thus, the filter 30 is configured to hold more composition in the applicator 3 in a single dip as compared to conventional eyeliner packages. In other embodiments, the filter 30 may also be a prefilled filter.

Figure 2:
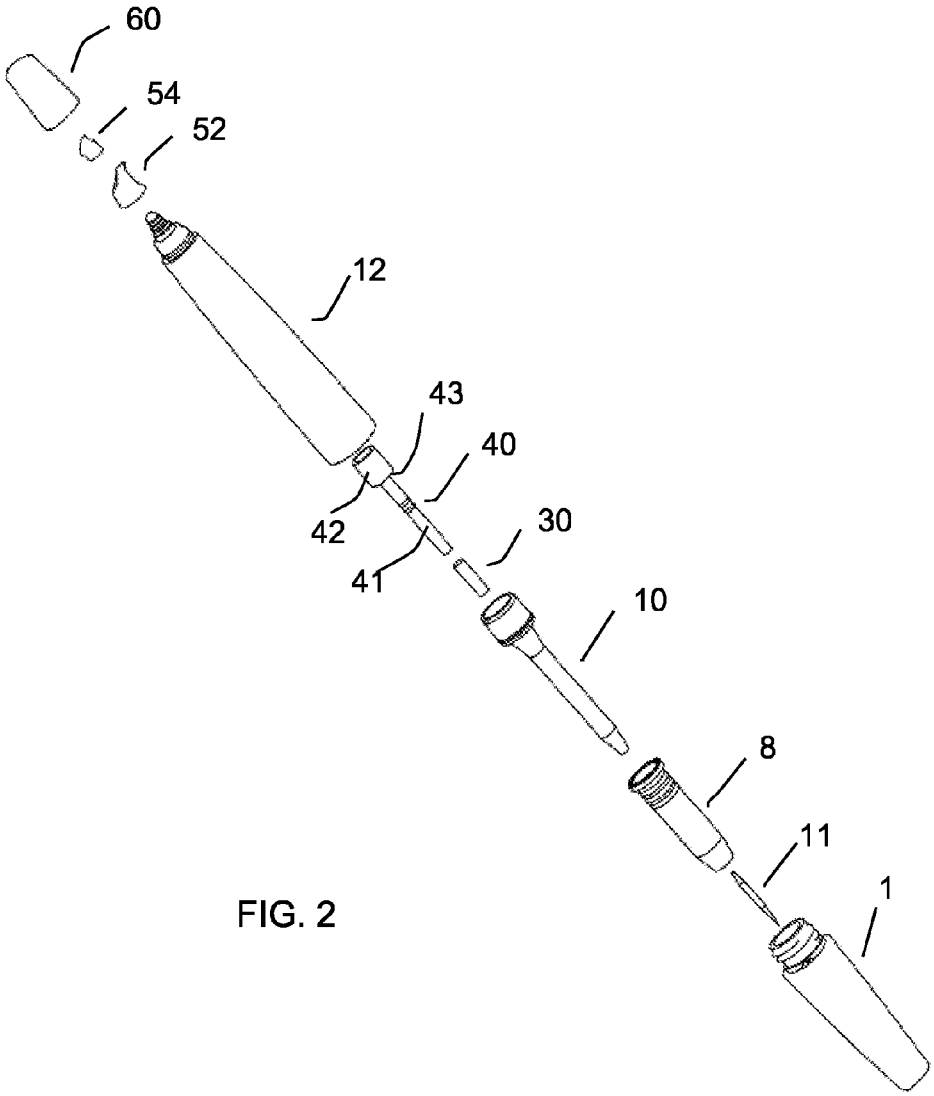
FIG. 2 is an exploded view of the packaging and applicator device of FIG. 1.

As shown in FIGS. 1 and 2, a plug 40 is adapted to be received within the cavity 13 from an open proximal end of the rod 10. The plug 40 comprising a first cylindrical shaft 41 and a second cylindrical portion 42 comprising an annular shoulder 43. The annular shoulder 43 of the plug 40 is sized for supporting engagement with an annular shoulder 10*a* of the rod 10. The first cylindrical shaft 41 of the plug 40 extends longitudinally inside the cavity 13 of the rod 10 and sealingly locks with an internal surface of the rod 10. Further, a distal end of the plug 40 rests on a top surface of the filter 30. The plug 40 thus prevents possibility of escape of fluid or of the filter 30 from the cavity 13 of the rod 10.

Further, as seen in FIG. 1, a corrector 50 is arranged on a proximal end portion 12*a* of the handle member 12, the corrector 50 is capable of correcting or erasing portions of a line drawn incorrectly during application using said applicator endpiece 11. The corrector 50 comprises of a first correcting member 52 and a second correcting member 54. In the present embodiment, the first correcting member is made of silicon material and the second correcting member is made of sponge. In other embodiments, the first correcting member 52 may be made up of other polymeric materials like polyethylene, thermoplastic elastomers, rubber and the like. In still other embodiments, the second correcting member 54 may be made up of other materials having absorbing properties for e.g., foam, cotton, modal, micromodal, Tencel®, and other viscose-based fibres, silica gel etc.

Figure 7:
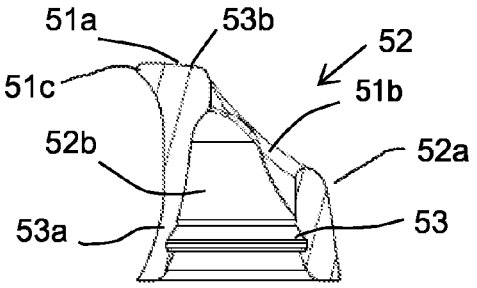
FIG. 7 is a cross sectional view of the first correcting member of FIG. 6.

As shown in FIGS. 1, 3-4 and 6-8, the first correcting member comprises a body 52*a* with a central bore 52*b*, and wherein the first correcting member 52 elongates along a central longitudinal axis of the device 1 (refer FIG. 1). Referring to FIGS. 1 and 7, the first correcting member 52 is snapped on a proximal end portion 12*a* of the handle member 12, and wherein the first correcting member 52 comprises at least one snapping groove 53 on its inner surface for receiving at least one snapping projection 14 present at a proximal end portion 12*a* of the handle member 12. The proximal end portion 12*a* of the handle member 12 is shaped in a conical form that can be received snappingly within the central bore 52*b* of the first correcting member 52.

Figure 8:
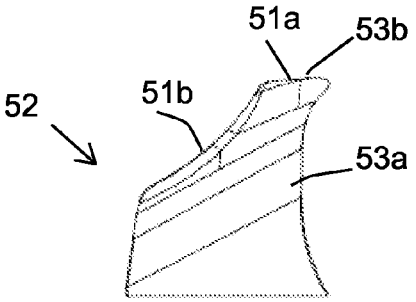
FIG. 8 is a side view of the first correcting member of FIG. 6.

As shown in FIGS. 7 and 8, the body 52*a* comprises at least one sidewall 53*a* and a top face 53*b*. The top face 53*b* includes a substantially flat surface portion 51*a* and a concavely inclined opening 51*b* of the central bore 52*b* extending down from the substantially flat surface portion 51*a*. Further, the substantially flat surface portion 51*a* projects outwardly from the at least one sidewall 53*a* of the body 52*a* of the first correcting member 52. The substantially flat surface portion 51*a* tapers as it extends outwardly and forms a narrow tip 51*c* away from the sidewall 53*a* of the first correcting member 52.

During application, the substantially flat surface portion 51*a* of the first correcting member 52 provides a tapering edge or a narrow tip 51*c* which can be used to aid in creating sharp edged lines.

Figure 9:
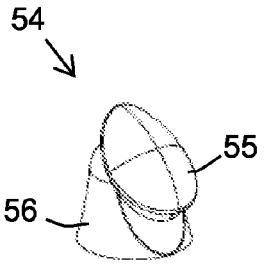
FIG. 9 is a perspective view of a second correcting member of a corrector of the packaging and applicator device of FIG. 1.
Figure 10:
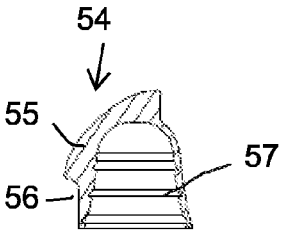
FIG. 10 is a cross sectional view of the second correcting member of FIG. 9.

Further, the second correcting member 54 is configured to be accommodated in the central bore 52*b* of the first correcting member 52 such that at least a portion of an upper surface of the second correcting member 54 projects from the concavely inclined opening 51*b* of the central bore 52*b* and forms a convex upper surface 55 at a distal end surface of the corrector 50, see FIGS. 1 and 9-10. More particularly, the second correcting member 54 is placed between the first correcting member 52 and the proximal end portion 12*a* of the handle member 12 before snapping the proximal end portion 12*a* of the handle member 12 into the central bore 52*b* of the first correcting member 52, so that when the handle member 12 and the first correcting member 52 are snapped a side wall 56 of the second correcting member 54 is sandwiched between the first correcting member 52 and the proximal end portion 12*a* of the handle member 12. Further, at least a portion of the proximal end portion 12*a* of handle member 12 is enclosed by the side wall 56 of the second correcting member 54. Further, at least one groove 57 on an inner surface of the side wall 56 is engaged with a corresponding at least one protrusion 14 on the said portion of the proximal end portion 12*a* of handle member 12.

During application, the second correcting member 54 helps in correcting or erasing the mistakes or bleeding marks. More particularly, the convex upper surface 55 of the second correcting member 54 helps in correcting or erasing the mistakes or bleeding marks.

Figure 3:
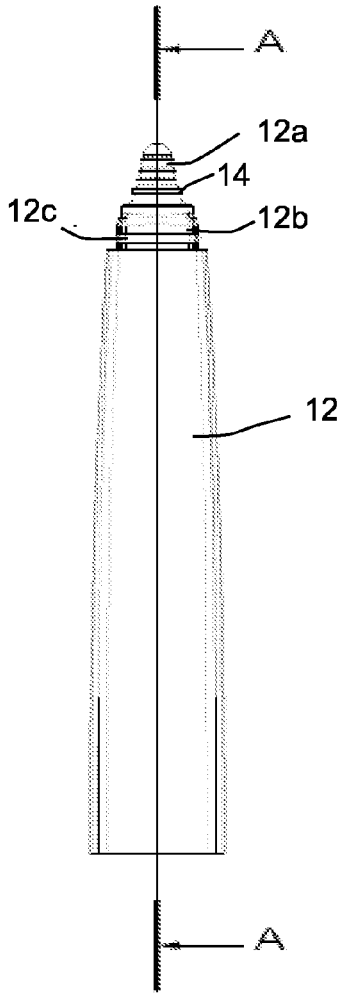
FIG. 3 is a front view of a handle member of the packaging and applicator device of FIG. 1.
Figure 4:
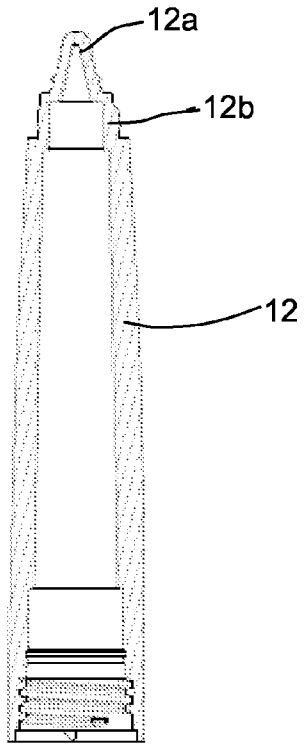
FIG. 4 is a cross-section of the handle member of FIG. 3 along axis A-A.

Furthermore, the handle member 12 comprises a neck portion 12*b* below the conical proximal end portion 12*a* of the handle member 12, refer FIGS. 1 and 3-4. A corrector cap 60 is provided for placement onto the neck portion 12*b* of the handle member 12 for protecting the corrector 50 from dust and contamination during non-use. As shown, the neck portion 12*b* comprises a retention bead 12*c* on its outer surface for snap-fit engagement with a groove 65 formed on an inner surface of a side wall of the corrector cap 60. In alternate embodiments, any other coupling means known in the art may be employed for coupling the corrector cap 60 on to the neck portion 12*b* of the handle member 12.

Various shape modifications may be made to the applicator endpiece 11 without going beyond the ambit of the present invention.

Figure 5:
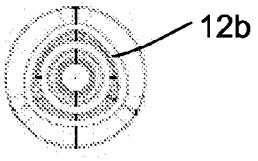
FIG. 5 is a top view of the handle member of FIG. 3.
Figure 6:
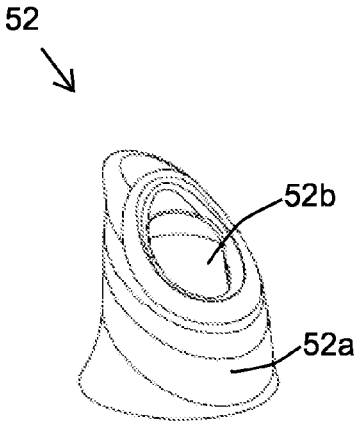
FIG. 6 is a perspective view of a first correcting member of a corrector of the packaging and applicator device of FIG. 1.
Figure 13:
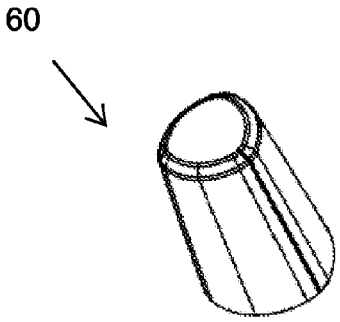
FIG. 13 is a perspective view of a corrector cap of the packaging and applicator device of FIG. 1.
Figure 14:
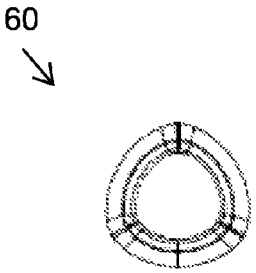
FIG. 14 is a top view of the corrector cap of FIG. 13.

The handle member 12 may present a shape that may or may not be a body of revolution, in particular it may have a flat sidewall shape. The handle member 12 may have a varying cross-sectional profile, as shown in FIG. 5, the handle ember 12 has a triangular cross-sectional profile towards a proximal portion thereof and a circular cross-sectional profile towards the distal portion thereof. Further, as shown in FIGS. 13 and 14, the corrector cap also has a triangular profile that matches with the triangular profile of the proximal portion of the handle member 12 on which it is mounted. In other embodiments, the handle member and the corrector cap may present a shape that may be a body of revolution.

The container 2 may be made in various ways, and for example it may be made other than by injection blow molding, for example it may comprise two parts that are assembled together.

Where appropriate, the wiper member may be molded integrally with one of the parts. Further, the wiper member can be made up of a single material or may be made up of two materials by bi-injection process.

The term "comprising a" should be understood as being synonymous with "comprising at least one".

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A packaging and applicator device for applying an eyeliner, the packaging and applicator device comprising:

a container containing a liquid composition for application;

an applicator capable of being fastened removably on the container, wherein the applicator includes a rod, an applicator endpiece at a distal end of the rod, and a handle member connected to a proximal end of the rod;

wherein a corrector is mounted at a proximal end of the handle member of the applicator, wherein the corrector comprises a first correcting member and a second correcting member, wherein the first correcting member comprises a body having a central bore, and wherein the first correcting member is configured to be mounted on a proximal end portion of the handle member, wherein the body of the first correcting member comprises at least one sidewall and a top face, and wherein the top face of the first correcting member includes a substantially flat surface portion and an inclined opening of the central bore extending downwards from the flat surface portion;

wherein the second correcting member is accommodated in the central bore of the first correcting member such that at least a portion of an upper surface of the second correcting member projects from the inclined opening of the central bore of the first correcting member;

wherein the first correcting member is configured to be snapped on the proximal end portion of the handle member; and wherein the first correcting member comprises at least one snapping groove on its inner surface for receiving at least one snapping projection present at the proximal end portion of the handle member.

2. The packaging and applicator device according to claim 1, wherein the upper surface of the second correcting member forms a convex application surface at a proximal end surface of the corrector.

3. The packaging and applicator device according to claim 1, wherein the proximal end portion of the handle member is conical in form.

4. The packaging and applicator device according to claim 1, wherein a side wall of the second correcting member is sandwiched between the first correcting member and the proximal end portion of the handle member.

5. The packaging and applicator device according to claim 1, wherein the first correcting member is made of silicon material.

6. The packaging and applicator device according to claim 1, wherein the second correcting member is made of sponge.

7. The packaging and applicator device according to claim 1, wherein the first correcting member is made up of a polymeric material selected from polyethylene, thermoplastic elastomers and rubber; and wherein the second correcting member is made up of a material having absorbing properties selected from foam, cotton, modal fabric, micro-modal fabric, other viscose-based fibers and silica gel.

8. The packaging and applicator device according to claim 1, wherein the applicator endpiece is made of felt.

9. The packaging and applicator device according to claim 1, wherein the rod is a hollow body and comprises a cavity having at least two different diameters, wherein the diameter of the cavity being smallest at a distal portion of the rod.

10. The packaging and applicator device according to claim 9, wherein the applicator endpiece comprises a body having a proximal portion, a middle portion and a distal portion; and wherein the middle portion of the applicator endpiece is received in the cavity having the smallest diameter at the distal portion of the rod and the distal portion of the applicator endpiece extends out from a distal opening of the cavity of the rod.

11. The packaging and applicator device according to claim 10, wherein the middle portion of the applicator endpiece is circularly cylindrical, and the proximal portion and the distal portion are conical or frustoconical in shape.

12. The packaging and applicator device according to claim 9, wherein the cavity of the rod houses a filter in a portion of the cavity of the rod adjacent to the distal portion of the cavity and a proximal portion of the applicator endpiece is inserted in the filter.

13. The packaging and applicator device according to claim 12, wherein the filter is made of an absorbent material that stores and supplies the liquid composition to the applicator endpiece during application.

14. The packaging and applicator device according to claim 9, wherein a plug is adapted to be received within the cavity of the rod and sealingly locks with an internal surface of the rod to prevent possibility of escape of a filter from the cavity of the rod.

15. The packaging and applicator device according to claim 14, wherein the plug comprises an annular shoulder sized for supporting engagement with an annular shoulder of the rod.

16. The packaging and applicator device according to claim 1, wherein the substantially flat surface portion of the first correcting member tapers as it extends outwardly from the sidewall of the first correcting member and forms a narrow tip away from the sidewall of the first correcting member.

17. The packaging and applicator device according to claim 1, wherein the handle member comprises a neck portion below the proximal end portion of the handle member; and wherein a corrector cap is provided for placement onto the neck portion of the handle member.

18. A packaging and applicator device for applying an eyeliner, the packaging and applicator device comprising:

a container containing a liquid composition;

an applicator capable of being fastened removably on the container, wherein the applicator includes a rod, an applicator endpiece at a distal end of the rod, and a handle member connected to a proximal end of the rod;

wherein a corrector is mounted at a proximal end of the handle member of the applicator;

wherein the corrector comprises a first correcting member and a second correcting member;

wherein the second correcting member is sandwiched between the first correcting member and a proximal end portion of the handle member;

wherein the first correcting member forms a narrow tip away from a sidewall of the first correcting member; and wherein the second correcting member forms a convex application surface at a proximal end surface of the corrector.

* * * * *